US007406850B2

(12) United States Patent
Lee et al.

(10) Patent No.: US 7,406,850 B2
(45) Date of Patent: Aug. 5, 2008

(54) HOT ROLLED STRIP COOLING DEVICE WITH COOLANT HEADER

(75) Inventors: Pil Jong Lee, Pohang-si (KR); Joo Dong Lee, Gwangyang-si (KR); Myung Jong Cho, Pohang-si (KR); Hui Seop Kwon, Pohang-si (KR); Sung Sup Eom, Pohang-si (KR)

(73) Assignee: POSCO, Gyeongsangbuk-do (KR)

( * ) Notice: Subject to any disclaimer, the term of this patent is extended or adjusted under 35 U.S.C. 154(b) by 0 days.

(21) Appl. No.: 11/648,841

(22) Filed: Dec. 28, 2006

(65) Prior Publication Data

US 2007/0251287 A1 Nov. 1, 2007

Related U.S. Application Data

(63) Continuation of application No. PCT/KR2005/002062, filed on Jun. 30, 2005.

(30) Foreign Application Priority Data

Jun. 30, 2004 (KR) ..... 10-2004-0049890

(51) Int. Cl.
*B21B 27/06* (2006.01)

(52) U.S. Cl. ..... 72/201

(58) Field of Classification Search ..... 72/201, 72/202

See application file for complete search history.

(56) References Cited

U.S. PATENT DOCUMENTS

| | | | | |
|---|---|---|---|---|
| 4,247,047 | A * | 1/1981 | Schaming | 239/391 |
| 4,507,949 | A * | 4/1985 | Killilea | 72/201 |
| 4,706,480 | A * | 11/1987 | Svatos | 72/11.4 |

FOREIGN PATENT DOCUMENTS

| | | | |
|---|---|---|---|
| JP | 55-054209 | * | 4/1980 |
| JP | 55054209 | * | 4/1980 |
| JP | 59-0921699 | | 11/1985 |
| JP | 2000-136079 | | 11/2001 |
| JP | 55-054210 | | 4/2008 |

OTHER PUBLICATIONS

PCT/KR2005/002062, Search Report, Published Sep. 9, 2005.

* cited by examiner

*Primary Examiner*—Derris H. Banks
*Assistant Examiner*—Debra M Wolfe
(74) *Attorney, Agent, or Firm*—Graybeal Jackson Haley LLP

(57) ABSTRACT

The present invention discloses a coolant header for hot rolled strip cooling devices, which cools a hot rolled strip fed from a finish rolling mill. The header includes a body provided with a plurality of discharging holes formed through the lower surface of the body such that the discharging holes are arranged along the width of the hot rolled strip and at least three rows of discharging holes are arranged along the length of the hot rolled strip; a coolant pipe provided in the coolant header, with an outlet hole formed on a side surface of the coolant pipe to discharge coolant; an inclined plate placed in front of the outlet hole of the coolant pipe such that the plate is inclined downwards, thus evenly distributing the coolant discharged from the outlet hole over the entire surface of the coolant header; a perforated plate placed above the discharging holes and causing the coolant to flow uniformly; and a flow stabilizing filter placed between the discharging holes and the perforated plate and causing the coolant to flow in a stabilized laminar manner. The present invention discharges a great amount of stabilized flow coolant onto the hot rolled strip, thus maximizing the strip cooling efficiency.

24 Claims, 2 Drawing Sheets

HOT ROLLED STRIP COOLING DEVICE WITH COOLANT HEADER

CROSS-REFERENCE TO RELATED APPLICATION

This is a continuation application that claims benefit, under 35 USC §120, of co-pending International Application PCT/KR2005/002062, filed Jun. 30, 2005, designating the United States, which claims foreign priority benefits under 35 USC §119(a) to Korean Patent Application No. 10-2004-0049890 filed Jun. 30, 2004 both of which are incorporated herein by reference.

TECHNICAL FIELD

The present invention relates, in general, to coolant headers to discharge coolant and, more particularly, to a coolant header for hot rolled strip cooling devices, which can maximize the hot rolled strip cooling efficiency.

BACKGROUND ART

Hot rolled strips, which are sequentially fed from a hot strip mill, are cooled while passing over a run-out table of the mill. In the above state, the process for cooling the hot rolled strips has typically been executed by spraying coolant from nozzles of a coolant header onto a hot rolled strip. Conventional coolant headers, which spray coolant onto hot rolled strips from nozzles, have been classified into turbulent flow-type headers, spray-type headers and laminar flow-type headers according to the coolant spraying style.

The turbulent flow-type coolant headers are configured such that high pressure is applied to the interior of a coolant header and coolant is sprayed onto a hot rolled strip. Thus, the turbulent flow-type headers necessarily have new devices to produce high pressure, thus having complex construction and increasing installation costs. Furthermore, the velocity of coolant sprayed from nozzles of the turbulent flow-type coolant header is very high, so that the flow of coolant which is sprayed from the nozzles and cools the hot rolled strips is unstable. Thus, when the turbulent flow-type coolant headers are used to cool hot rolled strips, large temperature deviations may be induced in each of the strips along the width of the strip.

On the contrary, the spray-type coolant headers to spray coolant through nozzles having small diameters may evenly spray coolant over the overall surface area of each hot rolled strip. However, the spray-type coolant headers are problematic in that the flow rate of coolant sprayed from a header per unit time is not too enough at normal pressure condition, so that the header cannot quickly cool the hot rolled strips and, furthermore, the strip cooling efficiency is reduced. Thus, it is not easy for the spray-type coolant headers to control the temperature of the strips while cooling the strips.

The laminar flow-type coolant headers solve the problems of the two above-mentioned types of coolant headers by discharging relatively stabilized coolant and by evenly cooling the hot rolled strips along the width of each strip.

FIG. 1 illustrates a sectional area of a conventional laminar flow-type coolant header having the above-mentioned properties.

As shown in FIG. 1, the conventional laminar flow-type coolant header comprises an outer tub 10 to store coolant therein, two inner tubs 20 to guide the coolant current discharged from the header onto the surface of a hot rolled strip, and a coolant supply pipe 30 to supply the coolant to the outer tub 10. In the coolant header, both the inner tubs 20 and the coolant supply pipe 30 are arranged along the width of the hot rolled strip.

The coolant supply pipe 30 is arranged between the two inner tubs 20 which are arranged in two lines, with two coolant outlet holes 31 formed on an end of the coolant supply pipe 30 so as to supply the coolant to the respective inner tubs 20. However, when the coolant discharged from the outlet holes 31 is directly introduced into the inner tubs 20, the coolant may flow undesirably quickly and become unstable. Thus, to allow the outlet coolant to flow stably, the outlet holes 31 are placed lower than the inlet holes of the inner tubs 20. Furthermore, to cause the coolant to reliably flow in the laminar flow pattern, both a perforated plate 40 and a flow stabilizing filter 50 are placed in a path through which the coolant flows to each inner tub 20. Therefore, the coolant, finally discharged from the inner tubs 20 through discharging holes 21, flows in a very stable flow pattern.

However, the conventional laminar flow-type coolant header having the above-mentioned construction is problematic in that, because the header has only two rows of discharging holes 21 in a single outer tub 10, the header may not discharge a large amount of coolant onto a hot rolled strip at one time, thus failing to provide a high cooling rate. Therefore, to quickly cool a hot rolled strip having a high temperature using the conventional laminar flow-type coolant headers, a great number of coolant headers must be coupled together in series, thus enlarging the size of a hot rolled strip cooling device and increasing the installation costs of the device.

Technical Problem

Accordingly, the present invention has been made keeping in mind the above problems occurring in the prior art, and an object of the present invention is to provide a coolant header for hot rolled strip cooling devices, which has several rows of discharging holes formed in a single body, thus discharging coolant in a relatively stabilized laminar flow pattern and quickly cooling hot rolled strips.

Technical Solution

According to an embodiment, the present invention provides a coolant header for hot rolled strip cooling devices, which cools a hot rolled strip fed from a finish rolling mill, comprising: a body provided with a plurality of discharging holes formed through the lower surface of the body such that the discharging holes are arranged along the width of the hot rolled strip and at least three rows of discharging holes are arranged along the length of the hot rolled strip; a coolant pipe provided in the coolant header, with an outlet hole formed on a side surface of the coolant pipe to discharge coolant; an inclined plate placed in front of the outlet hole of the coolant pipe such that the plate is inclined downwards, thus evenly distributing the coolant discharged from the outlet hole over the entire surface of the coolant header; a perforated plate placed above the discharging holes and causing the coolant to flow uniformly; and a flow stabilizing filter placed between the discharging holes and the perforated plate and causing the coolant to flow in a stabilized laminar manner.

Advantageous Effects

The present invention discharges laminar flow coolant in multiple rows, thus quickly cooling a hot rolled strip having a high temperature and more efficiently controlling the temperature of the hot rolled strip while controlling the strip.

MODE FOR INVENTION

Hereinbelow, a preferred embodiment of the present invention will be described in detail with reference to the accompanying drawings.

Figure 1:
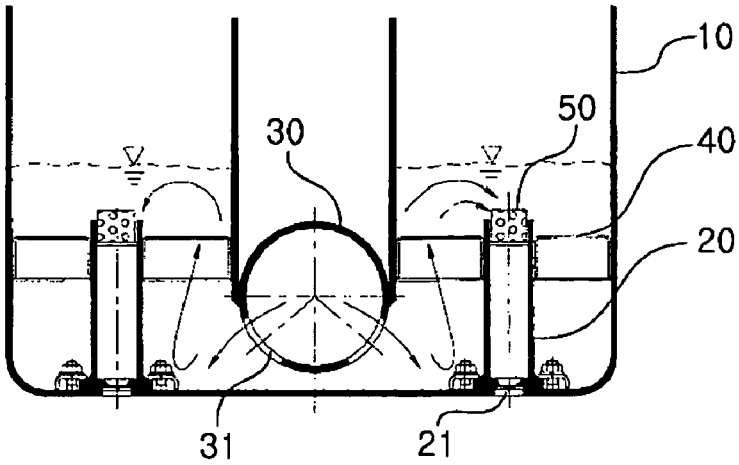
FIG. 1 (Prior Art)
FIG. 1 illustrates a conventional laminar flow-type coolant header.
Figure 2:
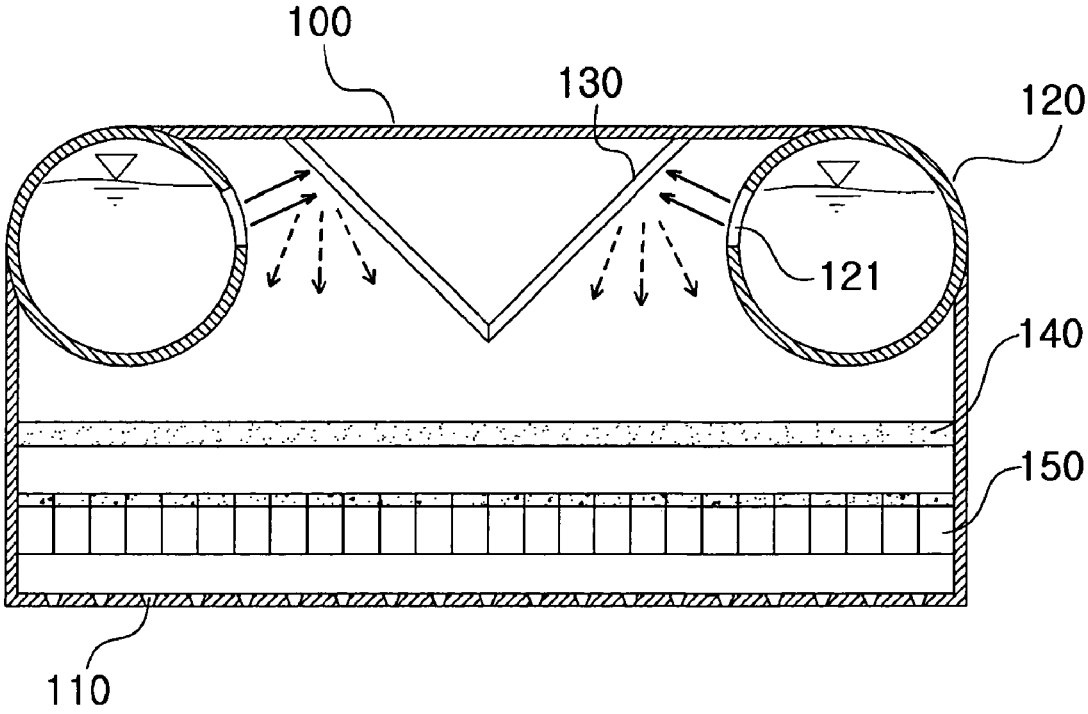
FIG. 2 illustrates the schematic construction of a coolant header for hot rolled strip cooling devices according to an embodiment of the present invention.

FIG. 2 illustrates the schematic construction of a coolant header for hot rolled strip cooling devices according to an embodiment of the present invention.

Figure 3:
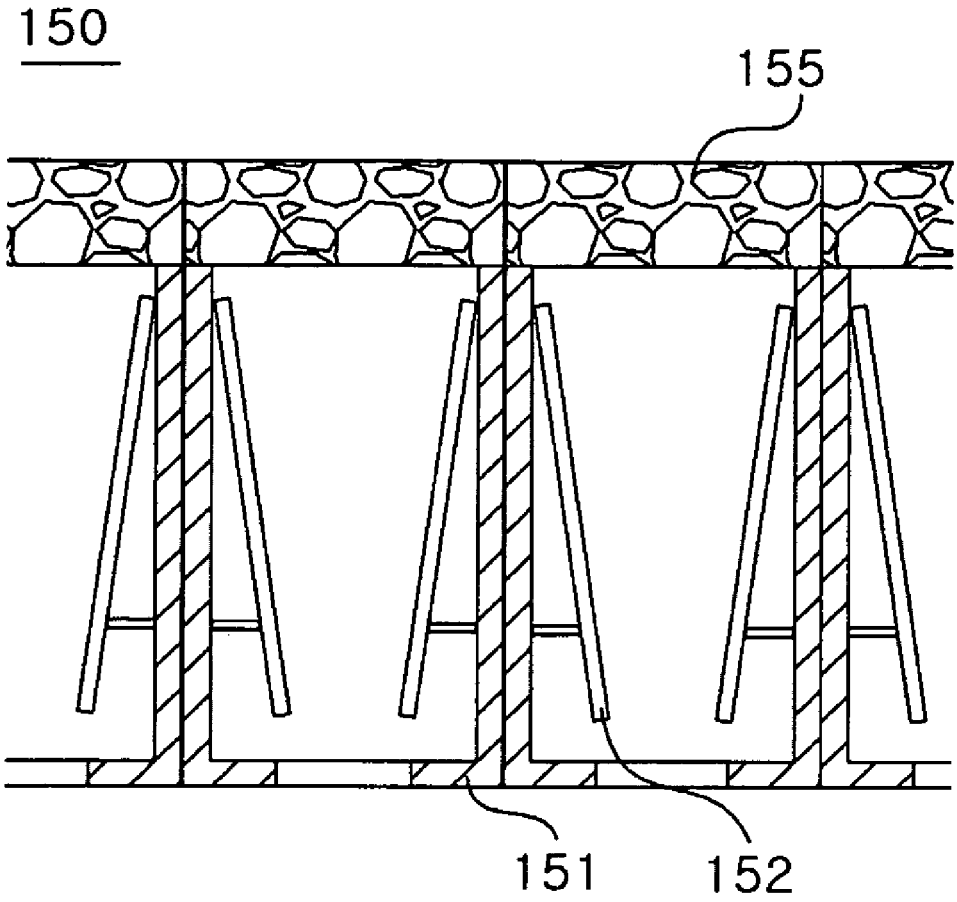
FIG. 3 illustrates the sectional area of a flow stabilizing filter of FIG. 2 in an enlarged view.
Figure 4:
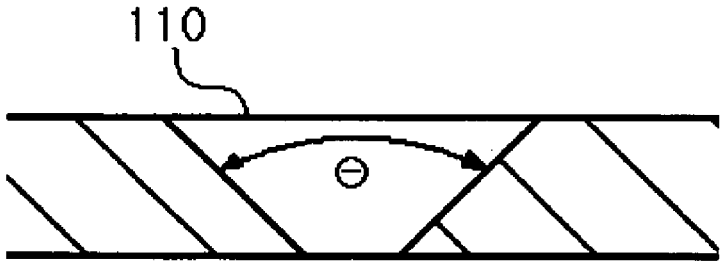
FIG. 4 illustrates the sectional area of a discharging hole of FIG. 2 in an enlarged view.

FIG. 3 illustrates the sectional area of a flow stabilizing filter of FIG. 2 in an enlarged view; and FIG. 4 illustrates the sectional area of a discharging hole of FIG. 2 in an enlarged view.

As shown in FIG. 2, the coolant header according to the present invention comprises a body 100, two coolant pipes 120, two inclined plates 130, a perforated plate 140, and a flow stabilizing filter 150.

The body 100 has a longitudinal tub structure having a tetragonal cross-section and is arranged along the width of the strip (in the vertical direction in the drawings). The lower surface of the body 100 is provided with a plurality of discharging holes 110 to discharge coolant. In the present invention, the discharging holes 110 are arranged along the length and width of the hot rolled strip such that the holes 110 are spaced apart from each other at regular intervals, thus a great quantity of coolant may be evenly discharged from the header onto the strip. Particularly, several rows of discharging holes 110 are arranged along the length of the hot rolled strip, so that a great amount of coolant may be discharged onto the strip. It is preferred to set the intervals between the discharging holes 110 to 20 mm to 30 mm. The above-mentioned intervals prevent the streams of coolant discharged from the holes 110 from interfering with each other. Furthermore, if the diameter of the discharging holes 110 is smaller than 3 mm, the coolant discharged from the holes 110 may be easily unstabilized. Thus, it is preferred to set the diameters of the discharging holes 110 at 5 mm to 10 mm.

The coolant pipes 120 are placed in the upper part of the body 100 and supply coolant from a coolant tank to the body 100. Each of the coolant pipes 120 is provided with an outlet hole 121 on a side surface thereof. To discharge the coolant upwards, the outlet hole 121 is formed on an upper part of the side surface of the coolant pipe 120. It is preferred to form the outlet holes 121 on respective pipes 120 at positions which are at angles ranging from 0 to 30 degrees above a horizontal axis passing through the centers of the two coolant pipes 120.

The inclined plates 130 are placed in front of the respective outlet holes 121 of the coolant pipes. Each of the plates 130 is inclined downwards, thus guiding the coolant discharged from the outlet hole 121 onto the lower surface of the body 100. Therefore, the coolant discharged from the outlet holes 121 collides with the inclined plates 130 and is scattered into several streams, thus being evenly distributed over the entire surface of the perforated plate 140. In the above state, to maximize the coolant distribution efficiency, it is preferred to make the surfaces of the inclined plates 130 uneven. In the preferred embodiment, the coolant pipes 120 are arranged along the width of the hot rolled strip. However, it should be understood that the coolant pipes may be arranged along the length of the hot rolled strip when necessary.

The perforated plate 140 having a great number of perforations is placed below both the coolant pipes 120 and the inclined plates 130. The perforated plate 140 is placed parallel to the lower surface of the body 100, so that the plate 140 secondarily distributes the coolant flowing from the inclined plates 130 and primarily reduces the velocity of the flowing coolant.

The flow stabilizing filter 150 is placed between the discharging holes 110 and the perforated plate 140.

As shown in FIG. 3, the flow stabilizing filter 150 comprises a pipe structure comprising a plurality of pipes having a polygonal cross-section arranged in parallel with each other, and a porous pad 155 placed on the upper end of the pipe structure. The cross-section of the plurality of pipes may be a tetragonal, pentagonal or hexagonal cross-section. The pipes 151 of the pipe structure may be arranged longitudinally and latitudinally over the entire surface area of the coolant header 100, thus having a predetermined lattice structure. The upper end of each pipe 151 is completely open, while the lower end of the pipe 151 is partially open, so that the sectional area of the open upper end thereof is larger than the sectional area of the open lower end. Thus, the flowing velocity of the coolant, which passes through the tetragonal pipes 151, is reduced, thereby becoming laminar due to the difference of the sectional area between the upper and lower ends of the pipes 151. If each of the pipes 151 is long, the flow of coolant may form vortices while the coolant flows along the long pipes 151. Thus, vortex prevention plates 152 may be installed in each of the pipes 151 as shown in FIG. 3.

A porous pad 155 is provided at the upper end of each of the pipes 151. The porous pad 155 may contain therein a predetermined quantity of coolant, as expected of a sponge, and causes the coolant to be introduced into the pipes 151 Furthermore, the porous pad 155 causes the coolant to flow in a horizontal direction due to capillary action of the porous pad 155 comprising a fine fibrous tissue. In other words, the porous pad 155 acts as a buffer which reduces the flow velocity of the coolant dropping from the perforated plate 140 and promotes uniform horizontal distribution of the coolant.

Therefore, the coolant, which sequentially passes through the perforated plate 140, porous pads 155 and pipes 151, becomes essentially uniform along a horizontal surface of the body 100, and, furthermore, the dropping velocity of the coolant is substantially reduced. Thus, when the coolant is discharged from the discharging holes 110 of the body 100, the flow of coolant becomes stabilized and laminar.

The lower surface of the body 100 is formed by a plate having predetermined thickness. Each of the discharging holes 110, formed through the plate of the lower surface of the body, is shaped as a nozzle which is tapered downwards as shown in FIG. 4. The tapered discharging holes 110 may increase the flow velocity of the coolant, which has been reduced to a low level through several stabilizing steps, to a desired level.

Generally, the coolant, discharged from a laminar flow-type coolant header, flows at a very low velocity, so that the streams of the coolant become thinner as the streams are spaced farther from the coolant header. Thus, the sectional area of the coolant, which actually cools the surface of a hot rolled strip, becomes reduced. In consideration of this problem, the present invention changes the arrangement of the discharging holes 110 to the above-mentioned structure. Thus, the present invention is advantageous in that the present invention maintains the streams of the coolant, discharged onto the surface of a hot rolled strip, constant, thereby increasing in practice the sectional area of the coolant which collides with the strip. Furthermore, the angle of each tapered discharging hole 110 of the present invention may be changed according to the distance between the body 100 and a hot rolled strip to be cooled. It is preferred to set the angle θ of the tapered discharging hole 110 to 90 to 120 degrees.

INDUSTRIAL APPLICABILITY

Although a coolant header for hot rolled strip cooling devices according to the preferred embodiment of the present invention has been disclosed in conjunction with the accompanying drawings for illustrative purposes, those skilled in the art will appreciate that various modifications, additions and substitutions are possible, without departing from the scope and spirit of the invention as disclosed in the accompanying claims.

The invention claimed is:

1. A coolant header for hot rolled strip cooling devices, which cools a hot rolled strip fed from a finish rolling mill, comprising:

a body provided with a plurality of discharging holes arranged along the length and width of the hot rolled strip;

a coolant pipe provided in the coolant header, with an outlet hole formed on a side surface of the coolant pipe to discharge coolant, wherein the outlet hole is formed at a position which is at an angle ranging from 0 to 30 degrees above a horizontal axis passing through a center of the coolant pipe, so that the coolant is discharged upwards through the outlet hole;

an inclined plate placed in front of the outlet hole of the coolant pipe such that the plate is inclined downwards, thus evenly distributing the coolant discharged from the outlet hole over an entire surface of the coolant header;

a perforated plate placed above the discharging holes and causing the coolant to flow uniformly; and a flow stabilizing filter placed between the discharging holes and the perforated plate and causing the coolant to flow in a stabilized laminar manner.

2. The coolant header for hot rolled strip cooling devices according to claim 1, wherein both the coolant pipe and the inclined plate are placed along the width of the body.

3. The coolant header for hot rolled strip cooling devices according to claim 1, wherein the flow stabilizing filter comprises:

a pipe structure comprising a plurality of pipes having a polygonal cross-section arranged in parallel with each other; and a porous pad placed on an upper end of the pipe structure, which stabilize the flow of coolant.

4. The coolant header for hot rolled strip cooling devices according to claim 3, wherein the cross-section of the plurality of pipes is selected from the group consisting of tetragonal, pentagonal and hexagonal cross-sections.

5. The coolant header for hot rolled strip cooling devices according to claim 3, wherein each of the plurality of pipes is configured such that a sectional area of an open upper end thereof is larger than a sectional area of an open lower end, and further comprises: a vortex prevention plate connected both to the open upper end and to the open lower end, and guiding the laminarly flowing coolant.

6. The coolant header for hot rolled strip cooling devices according to claim 1, wherein the inclined plate has an uneven surface to evenly distribute the coolant discharged from the outlet hole onto the perforated plate.

7. The coolant header for hot rolled strip cooling devices according to claim 1, wherein the discharging holes have diameters from 5 mm to 10 mm.

8. The coolant header for hot rolled strip cooling devices according to claim 1, wherein the discharging holes are spaced apart from each other at intervals from 20 mm to 30 mm.

9. The coolant header for hot rolled strip cooling device according to claim 1, wherein each of the discharging holes is defined by a tapered surface to gradually reduce a diameter of the discharging hole in a direction moving towards the hot rolled strip.

10. The coolant header for hot rolled strip cooling devices according to claim 9, wherein an angle of the tapered surface of each of the discharging holes is 90 to 120 degrees.

11. The coolant header for hot rolled strip cooling devices according to claim 2, wherein each of the discharging holes is defined by a tapered surface to gradually reduce a diameter of the discharging hole in a direction moving towards the hot rolled strip.

12. The coolant header for hot rolled strip cooling devices according to claim 3, wherein each of the discharging holes is defined by a tapered surface to gradually reduce a diameter of the discharging hole in a direction moving towards the hot rolled strip.

13. The coolant header for hot rolled strip cooling devices according to claim 4, wherein each of the discharging holes is defined by a tapered surface to gradually reduce a diameter of the discharging hole in a direction moving towards the hot rolled strip.

14. The coolant header for hot rolled strip cooling devices according to claim 5, wherein each of the discharging holes is defined by a tapered surface to gradually reduce a diameter of the discharging hole in a direction moving towards the hot rolled strip.

15. The coolant header for hot rolled strip cooling devices according to claim 6, wherein each of the discharging holes is defined by a tapered surface to gradually reduce a diameter of the discharging hole in a direction moving towards the hot rolled strip.

16. The coolant header for hot rolled strip cooling devices according to claim 7, wherein each of the discharging holes is defined by a tapered surface to gradually reduce a diameter of the discharging hole in a direction moving towards the hot rolled strip.

17. The coolant header for hot rolled strip cooling devices according to claim 8, wherein each of the discharging holes is defined by a tapered surface to gradually reduce a diameter of the discharging hole in a direction moving towards the hot rolled strip.

18. The coolant header for hot rolled strip cooling devices according to claim 11, wherein an angle of the tapered surface of each of the discharging holes is 90 to 120 degrees.

19. The coolant header for hot rolled strip cooling devices according to claim 12, wherein an angle of the tapered surface of each of the discharging holes is 90 to 120 degrees.

20. The coolant header for hot rolled strip cooling devices according to claim 13, wherein an angle of the tapered surface of each of the discharging holes is 90 to 120 degrees.

21. The coolant header for hot rolled strip cooling devices according to claim 14, wherein an angle of the tapered surface of each of the discharging holes is 90 to 120 degrees.

22. The coolant header for hot rolled strip cooling devices according to claim 15, wherein an angle of the tapered surface of each of the discharging holes is 90 to 120 degrees.

23. The coolant header for hot rolled strip cooling devices according to claim 16, wherein an angle of the tapered surface of each of the discharging holes is 90 to 120 degrees.

24. The coolant header for hot rolled strip cooling devices according to claim 17, wherein an angle of the tapered surface of each of the discharging holes is 90 to 120 degrees.

* * * * *